US005992452A

United States Patent [19]

Nelson, II

[11] Patent Number: 5,992,452

[45] Date of Patent: Nov. 30, 1999

[54] BALL AND SEAT VALVE ASSEMBLY AND DOWNHOLE PUMP UTILIZING THE VALVE ASSEMBLY

[76] Inventor: Joe A. Nelson, II, 6111 Allentown, Spring, Tex. 77389

[21] Appl. No.: 09/188,657

[22] Filed: Nov. 9, 1998

[51] Int. Cl.[6] ..... F16K 15/00; F04B 53/12

[52] U.S. Cl. ..... 137/533.11; 137/539.5; 137/533.13; 251/338; 417/554; 417/507

[58] Field of Search ..... 132/533.11, 533.13, 132/539, 529, 539.5, 512; 251/338; 417/507, 554, 430

[56] References Cited

U.S. PATENT DOCUMENTS

| | | | |
|---|---|---|---|
| 780,518 | 1/1905 | Miller | 137/533.13 |
| 880,019 | 2/1908 | Futhey | 417/554 |
| 1,585,544 | 5/1926 | Hubbard | 417/554 |
| 1,617,603 | 2/1927 | Larkin | 137/533.13 |
| 1,626,549 | 4/1927 | Miller | 137/533.13 |
| 1,632,948 | 6/1927 | Cardenas | 137/533.13 |
| 1,677,562 | 7/1928 | Lewis et al. | 137/533 |
| 1,696,007 | 12/1928 | Lewis et al. | 137/533 |
| 1,757,139 | 5/1930 | Platenberg | 137/533.13 |
| 1,919,641 | 7/1933 | Pippin | 417/430 |
| 2,231,861 | 2/1941 | Adams | 417/430 |
| 2,344,786 | 3/1944 | Patterson et al. | 103/179 |
| 3,139,039 | 6/1964 | Adams | 103/179 |
| 3,244,112 | 4/1966 | Parkin | 417/430 |
| 3,267,872 | 8/1966 | Bloudoff | 417/430 |
| 3,672,397 | 6/1972 | Watkins et al. | 137/539.13 |
| 3,749,521 | 7/1973 | Coone | 417/430 |
| 3,814,547 | 6/1974 | Kitrilakis et al. | 417/430 |
| 4,662,831 | 5/1987 | Bennett | 417/430 |
| 4,691,735 | 9/1987 | Horton | 137/533.11 |
| 4,781,547 | 11/1988 | Madden | 417/554 |
| 4,930,553 | 6/1990 | Grillo | 137/539.5 |
| 5,141,411 | 8/1992 | Klaeger | 417/430 |
| 5,183,075 | 2/1993 | Stein | 137/493.6 |
| 5,533,876 | 7/1996 | Nelson, II | 417/554 |
| 5,628,624 | 5/1997 | Nelson, II | 417/554 |
| 5,752,814 | 5/1998 | Starks et al. | 417/554 |

*Primary Examiner*—Henry Bennett
*Assistant Examiner*—Joanne Y. Kim
*Attorney, Agent, or Firm*—J.M. Mark Gilbreth

[57] ABSTRACT

Disclosed is a system used to increase the wear life of ball and seat valves and of ball and seat valves utilizing a piston mechanism to unseat the ball from the seat, which during operation, create turbulent flow within the valve preventing sand and other wear causing debris from collecting on and prematurely wearing pump components. Also disclosed is a wear and alignment bushing for ball and seat valves utilizing a piston to unseat the ball which reduces stress on the piston actuator.

19 Claims, 11 Drawing Sheets

BALL AND SEAT VALVE ASSEMBLY AND DOWNHOLE PUMP UTILIZING THE VALVE ASSEMBLY

BACKGROUND OF THE INVENTION

1. Field of the Invention

The present invention relates to valves and pumps. In another aspect, the present invention relates to ball and seat valves, and to pumps utilizing said valves. In even another aspect, the present invention relates to ball and seat valves utilizing a piston mechanism to unseat the ball from the seat, and to downhole pumps utilizing said valves. In still another aspect, the present invention relates to ball and seat valves including components to increase their wear life. In yet another aspect, the present invention relates to ball and seat valves including components to create turbulent flow within the valve preventing sand and other wear causing debris from collecting on and prematurely wearing the pump components.

2. Description of the Related Art

In the production of hydrocarbons from subterranean formations, it is desirable that the pressure of the formation "produce" or force the hydrocarbons to the surface. Unfortunately, sometimes formation pressure may be initially too low to produce the formation, or may decline to that point as hydrocarbons are produced from a formation. Resort must then be made to the use of a pump to produce the formation.

Most commonly in petroleum production technology, producing wells utilize a so called "sucker rod" to lift oil from subterranean formations to the surface of the earth. Sucker rod pumps are generally either a rod insert pump or a tubing pump. Tubing pumps are constructed such that the barrel assembly is an integral part of the tubing string and such that the plunger assembly is part of the rod string. Rod insert pumps, however, are of the stationary barrel traveling plunger type, wherein the barrel assembly is wedged into the seating nipple at the bottom of the tubing, thus providing a seal point.

In general a sucker rod pump is a reciprocating pump which is normally secured to the lowermost end of the sucker rod string, which extends longitudinally through the well bore from a reciprocating device at the surface of the ground. The reciprocating device at the surface is usually a horsehead type apparatus and alternatively raises and lowers a string of sucker rods in the well bore.

The sucker rod pump itself generally includes a housing through which a piston is reciprocated by the sucker rod linkage. In its simplest form, the pump usually includes a number of ball and seat valves with one such valve in the piston and another at the inlet port of the housing. On the upstroke of the plunger, the ball in the inlet port valve ("standing valve") is drawn away from its seat and the ball of the outlet port valve ("traveling valve") is forced over its seat to draw fluid from below the seating nipple and into the housing. On the piston's downstroke, the ball in the standing valve is forced into its seat and the ball in the traveling valve moves away from its seat to allow the piston to move downwardly through the fluid contained in the housing. On the subsequent upstroke, the closing of the traveling valve forces the fluid above the piston, out of the housing through the outlet ports and into the tubing above the pump and simultaneously fills the housing below the piston with fluid. Repetition of this cycle eventually fills the tubing string and causes the fluid to flow to the surface.

One problem encountered by sucker rod pumps is caused by the wear of the ball and seat valves. The fluid produced from many geological formations contains minute, abrasive particles, such as sand, which lodge between the ball and seat and wear away the valve components. Over a period of time, the sealing efficiency of the valves is reduced to such an extent that the pumo must be removed and repaired or replaced. In some wells, where the production fluid is particularly sandy or corrosive, these pumps must be replaced at frequent intervals. It is, of course, evident that removing and repairing or replacing a pump, and the associated losses of lost production time during the repair or replacement process, can be significant expense factors.

Another problem associated with such conventional ball and valve sub-surface oilfield pumps is generally known as "gas locking". In such pumps, the fluid head pressure in the tubing string is held by the traveling valve, on the upstroke of the piston, and by the lower standing valve on the downstroke of the piston. The down stroke of the traveling valve builds up pressure on the fluid between the traveling valve and the standing valve which causes the traveling valve to open to allow fluid to pass above the traveling valve. However, in a well producing both oil and gas, the chamber between the traveling valve and the standing valve, frequently fills with gas, and due to the compressibility of gas, the downstroke of the traveling valve may not build up sufficient pressure in the chamber below the traveling valve to act upwardly on the ball of the traveling valve to overcome the immense pressure of the fluid column above the traveling valve which acts downwardly on the ball of the traveling valve, resulting in the ball of the traveling valve remaining in the closed seated position during the downstroke. Thus, the gas between the standing valve and the traveling valve merely compresses and expands with each stroke of the pump, producing the operational failure of the pump known as "gas locking". This condition may remedy itself after a short time or may continue indefinitely.

Even another problem associated with such conventional ball and valve sub-surface oilfield pumps is generally known as "fluid pounding." This fluid pounding occurs when the pump does not fill completely with liquid during the upstroke, resulting in the formation of a low pressure gas cap in the top of the pump chamber between the traveling valve and the standing valve. During the subsequent downstroke the traveling valve stays closed until it impacts the fluid.

There has been a long felt need to solve the above described problems associated with such conventional ball and valve sub-surface oilfield pumps, and the art is replete with attempts to solve one or more of the above problems.

U.S. Pat. No. 1,585,544, issued May 18, 1926 to Hubbard, discusses the problem of "air hammering", and suggests the use of a rod mounted on the standing valve which impacts the ball of the traveling valve as the traveling valve is moved toward the standing valve. However, given the expansion and contraction of the sucker rods, the traveling valve may not reach the rod, or may extend past the rod, damaging the valve.

U.S. Pat. No. 4,691,735, issued Sep. 8, 1987 to Horton, discloses a traveling valve for an oil well pump, which includes a piston below the traveling valve which lifts the traveling valve ball above the traveling valve seat. On the downstroke, pressure builds up between the standing valve and the piston, to force the piston upward to lift the ball. However, since the piston cross-sectional area affected by the pressure between the standing valve and the piston is equal to the cross-sectional area of the traveling valve seat, no mechanical advantage is provided by the arrangement of Horton. Thus, Horton suffers from "gas locking" to the same extent as conventional traveling valves. Additionally, the Horton traveling valve and the rod assembly are not mounted below the bottom of the plunger, and thus must be made of materials strong enough to withstand the rigors of operation of the pump.

U.S. Pat. No. 4,781,547, issued Nov. 1, 1988 to Madden, discloses a pushrod assembly mounted below the traveling valve, which pushrod is alternatively moved from an extended into a retracted position each upstroke and downstroke of the pump. The free terminal end of the pushrod is arranged to engage the traveling valve ball as the pump commences the downstroke. However, since the bottom of the pushrod includes several channels, pressure does not build up between the pushrod and the standing valve during the downstroke. Rather, during the downstroke liquid is forced through the channels in the bottom of the pushrod. Movement of the pushrod is affected by inertia, pressure differential of the liquid flow through the channels, and friction between the pushrod and the pump barrel.

Therefore, there is a need in the art for an improved downhole reciprocating pump.

There is another need in the art for an improved apparatus for reducing the wear of a downhole reciprocating pump by preventing sand and other debris from collecting on and wearing pump components.

These and other needs in the art will become apparent to those of skill in the art upon review of this patent specification, claims and drawings.

SUMMARY OF THE INVENTION

It is an object of the present invention to provide an improved downhole reciprocating pump.

It is another object of the present invention to provide for an improved apparatus for reducing the wear of a downhole reciprocating pump by preventing sand and other debris from collecting on and wearing pump components.

These and other objects of the present invention will become apparent to those of skill in the art upon review of this patent specification, claims and drawings.

According to one embodiment of the present invention there is provided a ball and seat valve assembly which generally includes a hollow tubular member holding a ball and valve. Mounted within the tubular member below the valve seat is a piston with an actuator for engaging the seated ball. Mechanical advantage is provided either by providing a sealing area of the piston that is greater than the sealing area of the seat valve and/or by providing an actuator suitable to strike the seated ball asymmetrically with respect to the vertical axis through the center line of the ball.

According to another embodiment of the present invention there is provided a ball and seat assembly which generally includes a ball and seat valve. Mounted to the bottom of the valve is a tubular member having therein a piston with an actuator for engaging the seated ball. Mechanical advantage is provided either by providing a sealing area of the piston that is greater than the sealing area of the seat valve and/or by providing an actuator suitable to strike the seated ball asymmetrically with respect to the vertical axis through the center line of the ball.

According to even another embodiment of the present invention there is provided a ball and seat assembly which generally includes a first tubular member containing a ball and seat valve. Mounted to the bottom of the first tubular member is a second tubular member having therein a piston with an actuator for engaging the seated ball. Mechanical advantage is provided either by providing a sealing area of the piston that is greater than the sealing area of the seat valve and/or by providing an actuator suitable to strike the seated ball asymmetrically with respect to the vertical axis through the center line of the ball.

According to still another embodiment of the present invention there is provided a pump assembly which generally includes a pump housing with a movable barrel positioned therein. Affixed to the barrel is a traveling ball and seat valve. Mounted to the bottom of barrel is a tubular member having therein a piston with an actuator for engaging the seated ball. Mechanical advantage is provided either by providing a sealing area of the piston that is greater than the sealing area of the seat valve and/or by providing an actuator suitable to strike the seated ball asymmetrically with respect to the vertical axis through the center line of the ball.

According to yet another embodiment of the present invention there is provided a ball and valve seat assembly. The assembly generally includes a hollow tubular member having an interior wall defining an internal cross-sectional area. A valve seat is mounted within the tubular member, having a seating passage with a seating cross-sectional area and a ball positioned above the valve seat. A piston is moveably mounted withing the tubular member below the valve seat. The piston includes an actuator for engaging the ball through the passage and a sealing member with a sealing area for sealing the tubular member below the valve seat across the entire internal cross-sectional area of the tubular member. The assembly also includes an actuator guide positioned within the tubular member below the valve seat. The guide defines an actuator passage for receiving the actuator and is positioned such that a portion of the actuator is within the actuator passage.

According to even yet another embodiment of the present invention there is provided a ball and seat valve assembly which generally includes a hollow tubular member having an interior wall defining an internal cross-sectional area. A valve seat is mounted within the tubular member, having a seating passage with a seating cross-sectional area and a ball positioned within the tubular member above the valve seat. A piston is moveably mounted withing the tubular member below the valve seat. The piston includes an actuator for engaging the ball through the passage while the ball is seated on the seat and a sealing member with a sealing area for sealing the tubular member below the valve seat across the entire internal cross-sectional area of the tubular member. The assembly also includes at least one turbulent flow disk positioned within the tubular member above the ball and valve seat substantially spanning the cross-sectional area with the flow disk defining fluid passages providing fluid communication between the internal cross-sectional area above the flow disk and the internal cross-sectional area below the flow disk.

According to still yet another embodiment of the present invention there is provided a ball and seat valve assembly which generally includes a hollow tubular member having an interior wall defining an internal cross-sectional area. A valve seat is mounted within the tubular member, having a seating passage with a seating cross-sectional area and a ball positioned within the tubular member above the valve seat. A piston is moveably mounted withing the tubular member below the valve seat. The piston includes an actuator for engaging the ball through the passage while the ball is seated on the seat and a sealing member with a sealing area for sealing the tubular member below the valve seat across the entire internal cross-sectional area of the tubular member.

The assembly also includes at least one turbulent flow disk positioned within the tubular member above the ball and valve seat. The assembly further includes a system positioned within the tubular member for keeping particulate matter in suspension. This scrap and flush system includes: 1) a main body positioned within the tubular member above the ball and seat valve substantially spanning the tubular member cross-sectional area with the main body defining fluid passages providing fluid communication between the internal cross-sectional area above the main body and below the main body; and 2) a gathering surface within the fluid passage for gathering the particulate matter.

DETAILED DESCRIPTION OF THE INVENTION

Referring now to the figures the present invention will be shown and described in detail.

Figure 1A:
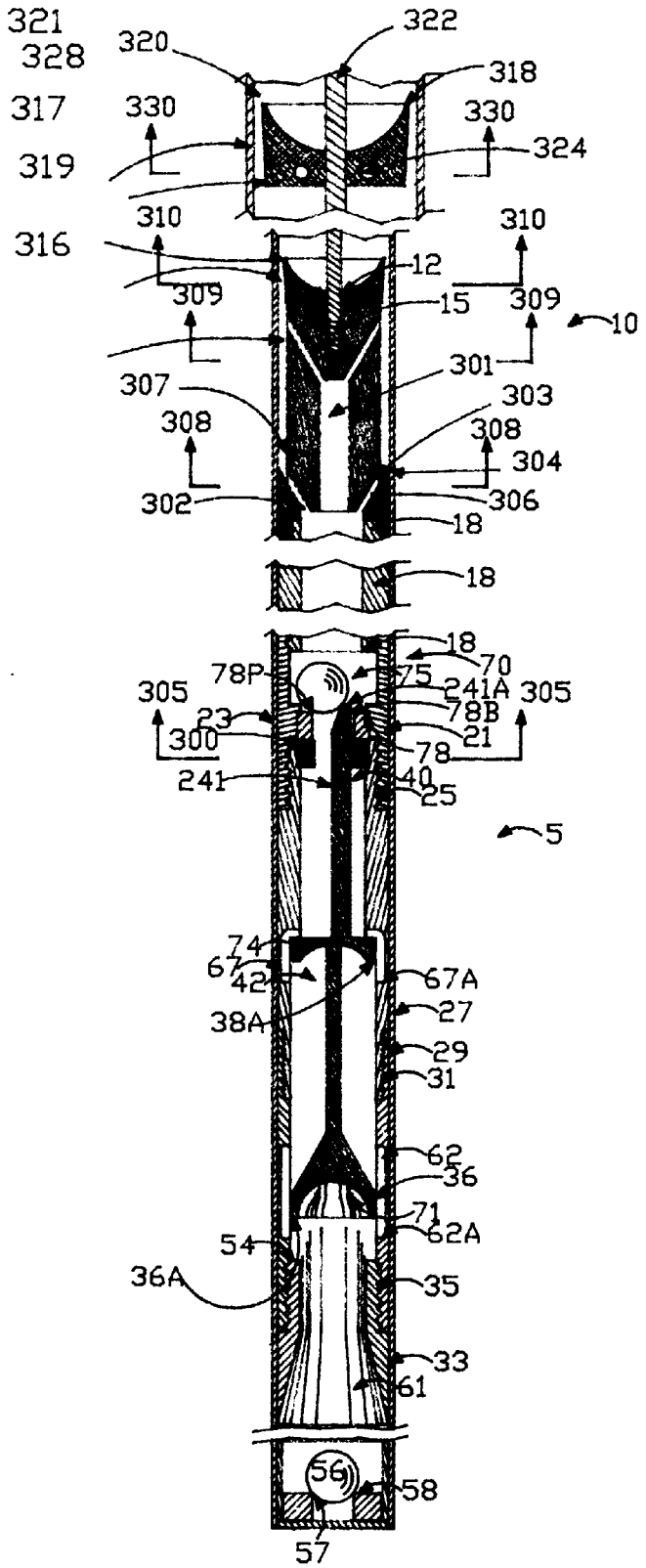
FIGS. 1A, and 1B are cross-sectional views of reciprocating fluid pump 10 of the present invention showing piston 40 in a lower and in an upper position, respectively.
Figure 1B:
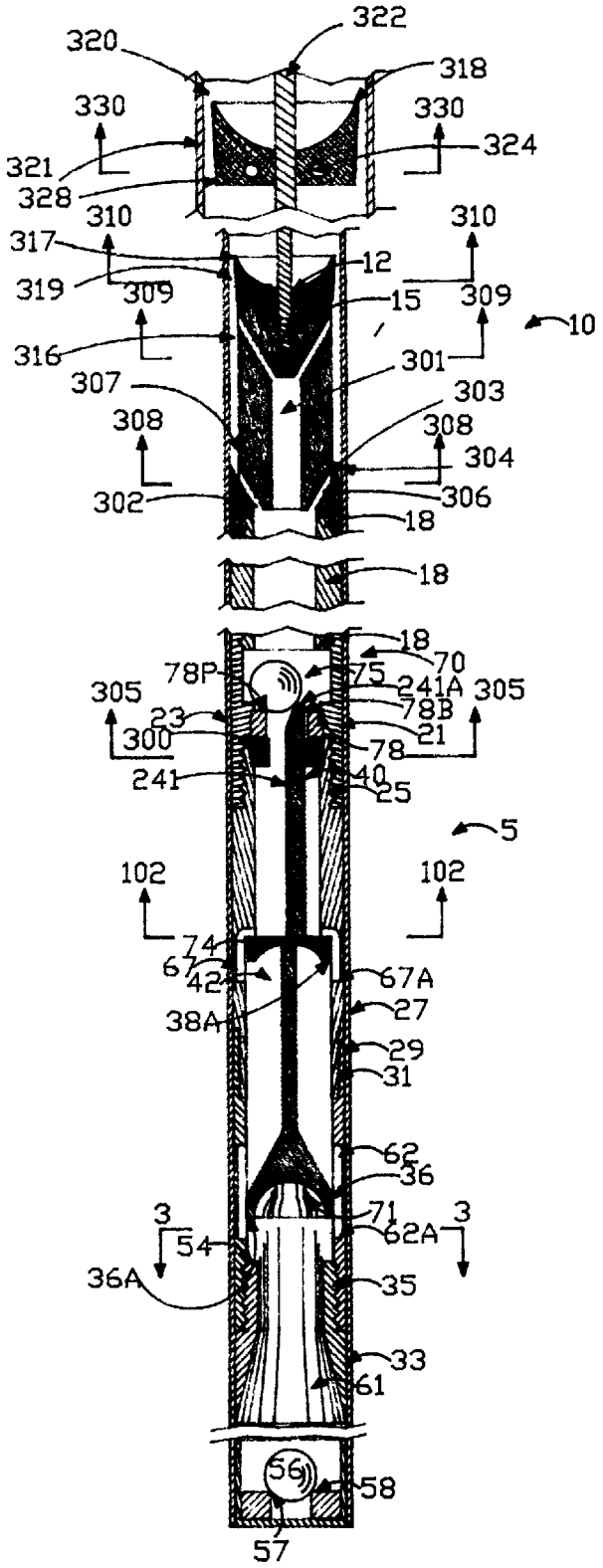

FIGS. 1A, and 1B are cross-sectional views of reciprocating fluid pump 10 of the present invention showing piston 40 in a lower and in an upper position, respectively.

In general, sucker rod 322 connects to and actuates pump pull rod 12. Sucker rod 322 is actuated from the surface by any of the well known means, usually a "rocking horse" type pumpjack unit. Connected to sucker rod 322 is turbulent flow disk 318. Flow disk 318 is connected to sucker rod 322 by any suitable means. Preferably, flow disk 318 will include two halves bolted together around sucker rod 322 by means of bolts or screws threaded through holes 324 then secured.

Although the figures illustrate only one flow disk 318 attached to sucker rod 322, it is understood that any number of flow disks 318 may be so attached. While not being limited by theory, the inventor believes that several flow disks 318 attached to sucker rod 322 will not only aid it the generation of turbulent flow, but will also prevent premature buckling of sucker rod 322 thereby increasing its useful life. Flow disk 318 may be made of any suitable material. Non-limiting examples of suitable materials include metal, steel and plastic. Preferab y, flow disk 318 is made of steel.

Figure 4A:
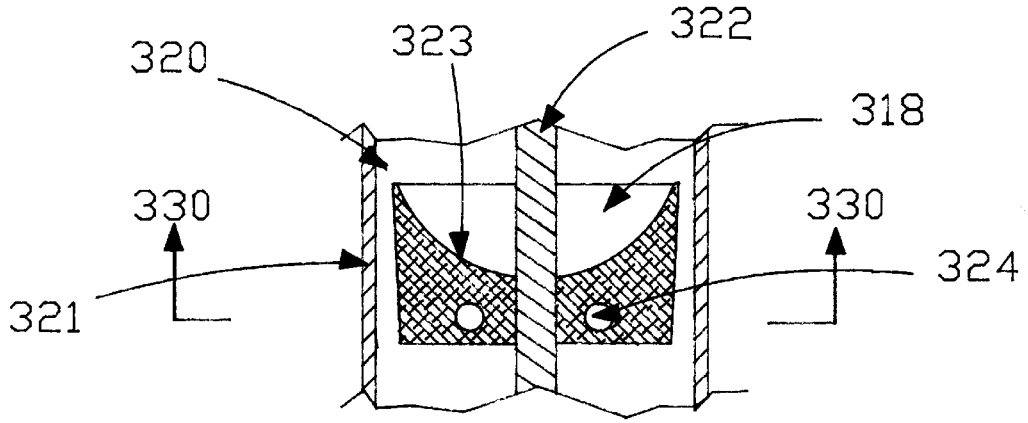
FIG. 4A is an enlarged view of a portion of FIGS. 1A and 1B showing turbulent flow disk 318 having catch basin 333 and bolt holes 324 attached to sucker rod 322 forming flow area 320 between disk 318 and outer tubing 321.
Figure 5:
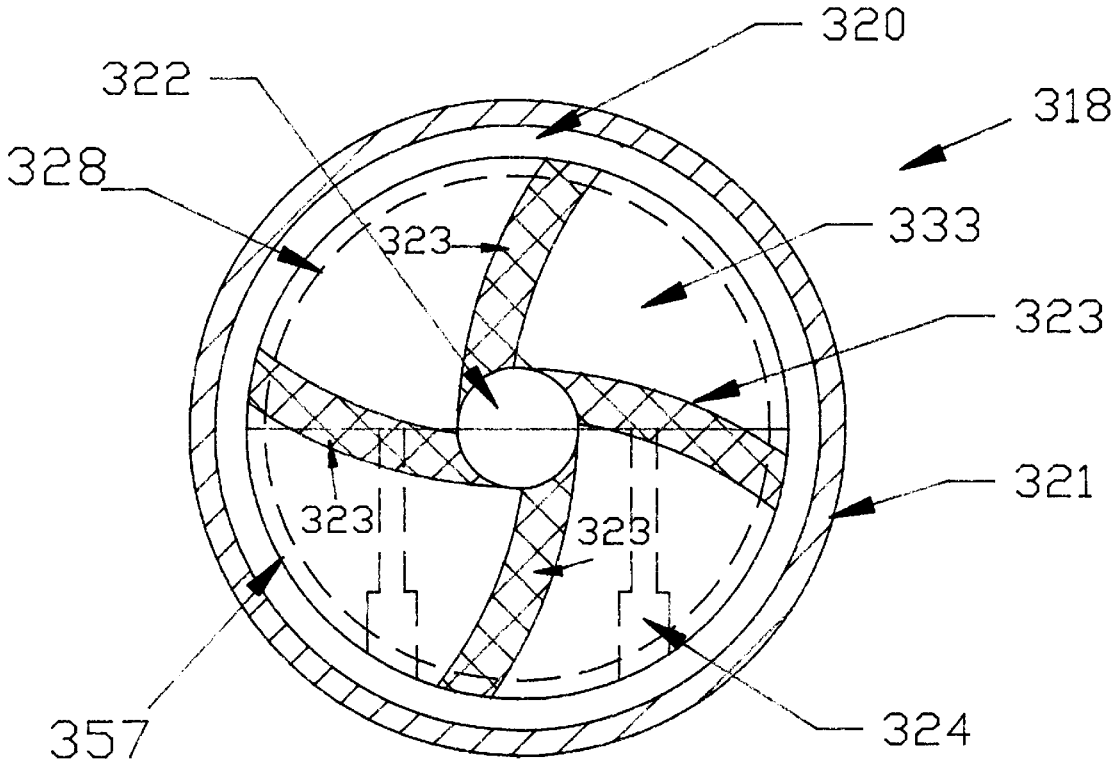
FIG. 5 is a horizontal cross-sectional view of sucker rod turbulent flow disk 318 taken along line 330—330 of FIG. 4A showing flow area 320, tubing 321, flow vanes 323, catch basin 333, edge 357 and screw hole 324.

Referring now to FIGS. 4A and 5 there is shown an enlarged view of flow disk 318 of FIGS. 1A and 1B attached to sucker rod 322 and a horizontal cross-sectional view of sucker rod turbulent flow disk 318 taken along line 330—330 of FIG. 4A respectfully.

Preferably, flow disk 318 is somewhat dish shaped and includes catch basin 333 to collect any solids that fall out of suspension away from wear parts of pump 10. Sucker rod turbulent flow disk 318 includes flow vanes 323 to aid in the production of turbulent flow. While shown in the figures to include four flow vanes 323 it is understood that any suitable number to produce adequate turbulent flow may be utilized. In addition, while shown in the figures to be somewhat ridge shaped, it is understood that flow vanes 323 may be any shape suitable to induce turbulent flow.

The purpose of flow disk 318 is to create turbulent flow out of pump 10 on the upstroke and the downstroke to keep sand and other particle, in suspension in the tubing above pump 10 thereby keeping the solids from collecting upon and causing unnecessary wear to the components of pump 10 specifically, to plunger 18, actuator 241, ball 75 and seat 78. Liquid flows past flow disk 318 through flow area 320 formed between disk 318 and outer tubing 321.

Pump pull rod 12 in turn connects to reciprocating fluid pump 10 via threaded connection to plunger connector 15. Turbulent flow disk 317 is attached to or part of the top of plunger connector 15 and scrape and flush system 350 is attached to the bottom of plunger connector 15.

Figure 4B:
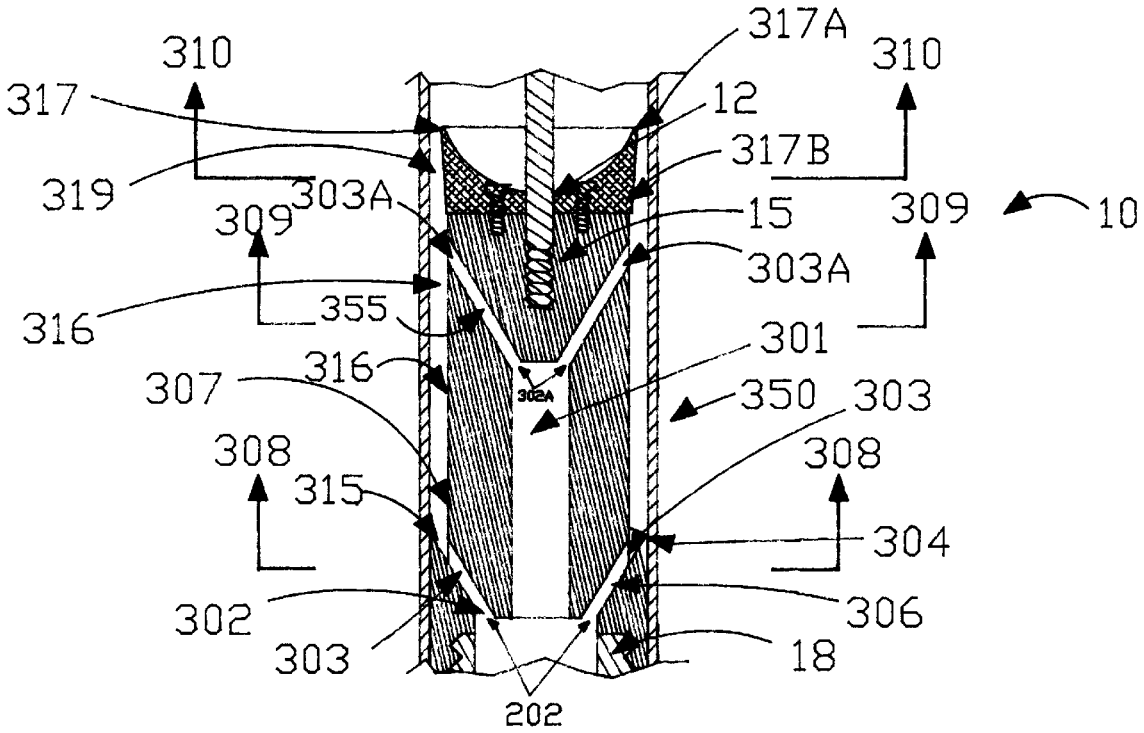
FIG. 4B is an enlarged view of a portion of FIGS. 1A and 1B showing pump pull rod 12, turbulent flow disk 317 and scrape and flush system 350 attached to plunger connector 15 where system 350 includes main body 307 scraping edge 304 reduced flow channel 301 diagonal flow channels 355 and flush channels 306.
Figure 6:
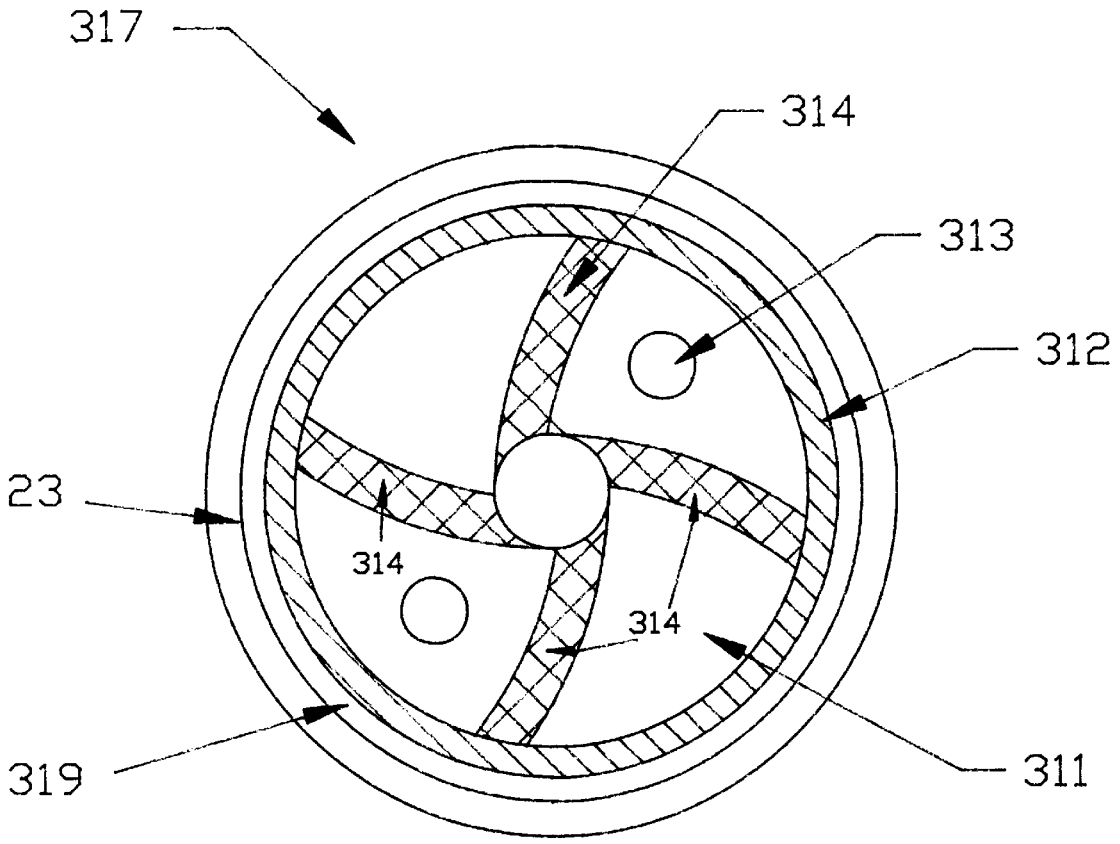
FIG. 6 is a horizontal cross-sectional view of pump pull rod turbulent flow disk 317 taken along line 310—310 of FIG. 4B showing catch basin 311, disk cup edge 312, bolt holes 313, and flow vanes 314.

Referring now to FIGS. 4B and 6 there is shown an enlarged view of a portion of FIGS. 2A and 12 showing turbulent flow disk 317 attached to pump pull rod 12 and a horizontal cross-sectional view of pump pull rod turbulent flow disk 317 taken along line 310—310 of FIG. 4B respectively. Flow disk 317 is attached to plunger connector 15 by any suitable means. Preferably, flow disk 317 attaches plunger connector 15 by means of bolts threaded through holes 313.

Pump pull rod turbulent flow disk 317 includes flow vanes 314 to aid in the production of turbulent flow. While shown in the figures to include four flow vanes 314, it is understood that any suitable number to produce adequate turbulent flow may be utilized. In addition, while shown in the figures to be somewhat ridge shaped, it is understood that flow vanes 314 may be any suitable shape to induce turbulent flow. Flow disk 317 also includes a cupped edge 312 (see FIG. 6).

The purpose of flow disk 317 is to create turbulent flow out of pump 10 or the downstroke to keep sand and other particles, in suspension thereby keeping the solids away from the wear parts of pump 10 which include plunger 18, piston 40, actuator 241, ball 75 and seat 78. The purpose of cupped edge 312 is to create turbulent flow out of pump 10 on the down stroke.

Preferably, flow disk 317 is somewhat dish shaped and includes catch basin 311 to collect any solids that fall out of suspension away from wear parts of pump 10. Liquid flows past disk 317 through flow area 319 formed between disk 317 and barrel 23. Preferably, flow disk 317 is shaped such that flow area 319 is smaller at top 317A of flow disk 317 than at bottom 317B of flow disk 317 to create more turbulent flow.

Referring now to FIG. 43, there is also shown an enlarged view of system for keeping particulate matter in suspension also called scrape and flush system 350 attached below plunger connector 15. Scrape and flush system 350 may attach to plunger connector 15 by any suitable means. Preferably, plunger connector 15 screws into scrape and flush system 350. In addition, scrap and flush system 350 could be an integral part of plunger 18.

Scrape and flush system 350 includes main body 307 which has a scraping edge 304 and defines reduced flow channel 301, diagonal flow channels 355 having inlet 302A and outlet 303A and flush channels 306 having inlet 302 and outlet 303. Circumferential channel 316 is formed between flush system body 307 and barrel 23.

Figure 7:
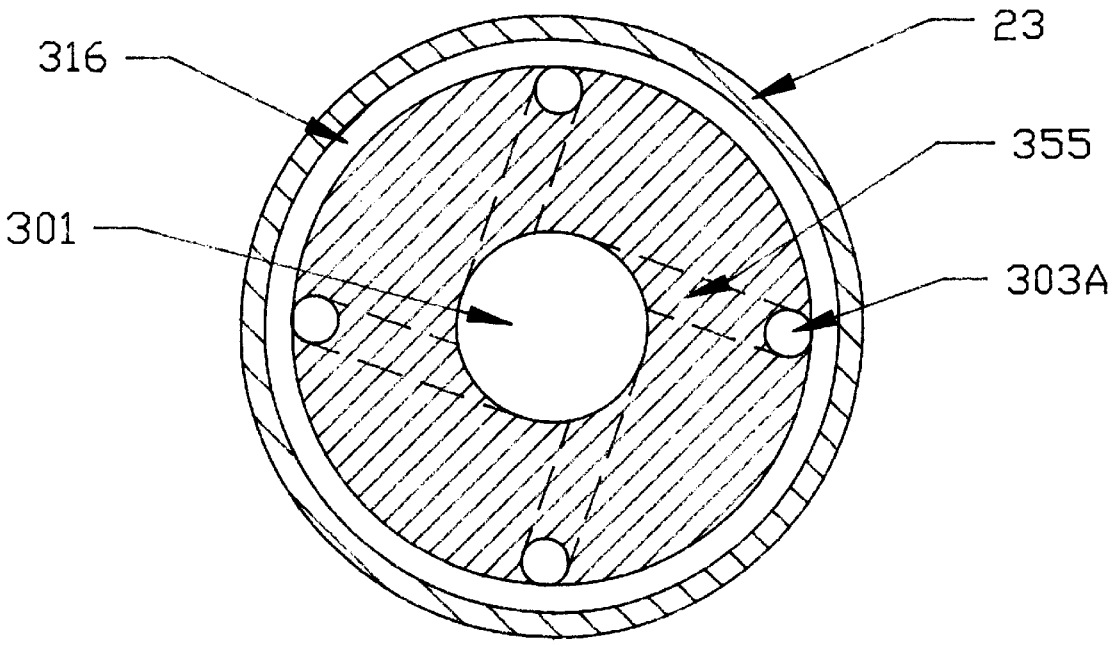
FIG. 7 is a horizontal cross-sectional view of scrape and flush system 350 taken along line 309—309 of FIG. 4B showing reduced flow channel 301, angled flush port 355, flush port outlet 303A, circumferential channel 316 and pump barrel 23.
Figure 8:
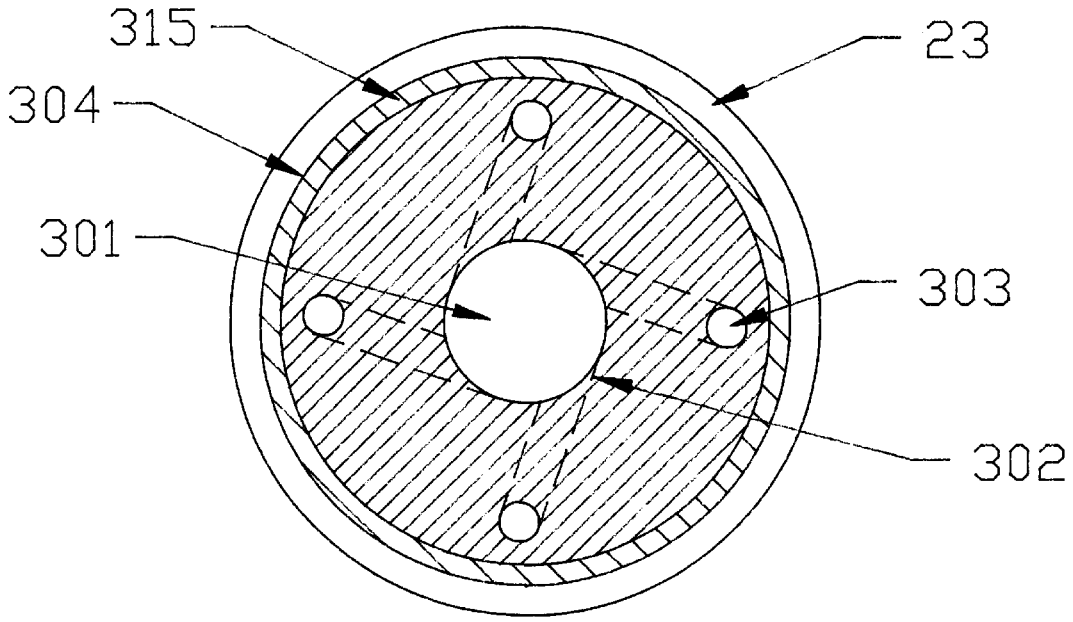
FIG. 8 is a horizontal cross-sectional view of scrape and flush system 350 taken along line 308—308 of FIG. 4B showing flow channel 306, flush port inlet 302, flush port outlet 303, scraping edge 304, and reduced flow port 301.
Figure 9:
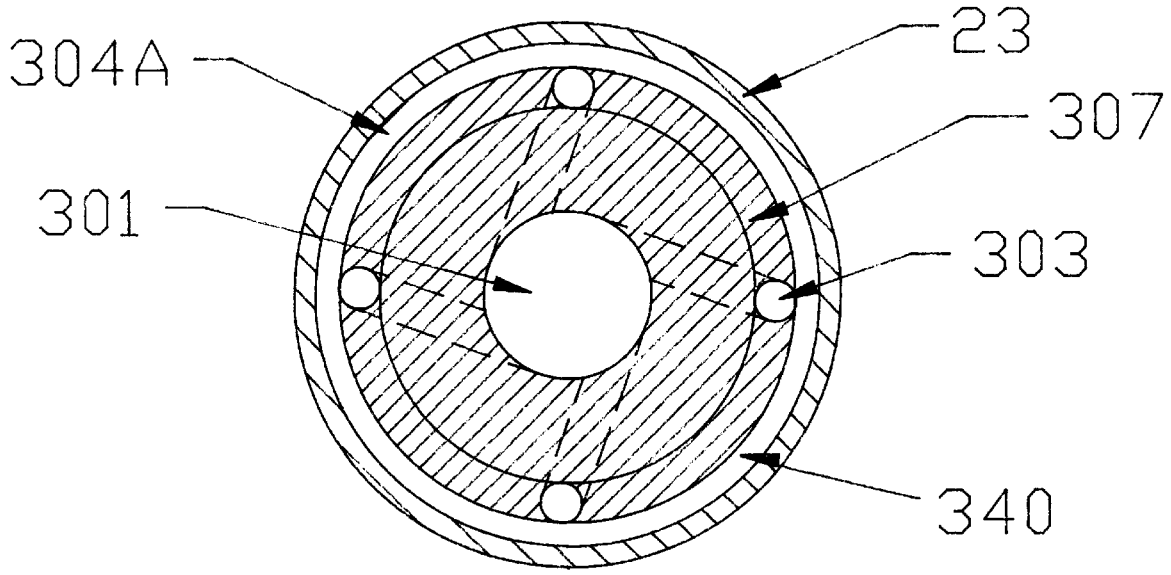
FIG. 9 is a horizontal cross-sectional view of a second embodiment of scrape and flush system 350 taken alone line 308A—308A of FIG. 4C. showing main body 307, replaceable wear part 340 having scraping edge 304A, flow channel 301, flush port inlet 302, flush port outlet 303, and pump barrel 23.

Referring now additionally to FIGS. 7 and 8 there is shown a horizontal cross-sectional view of scrape and flush system 350 taken along line 309—309 and along line 308—308 of FIG. 4B, respectively. FIG. 9 is a horizontal cross-sectional view of a second embodiment of scrape and flush system 350 taken along line 308A—308A of FIG. 4C showing replaceable wear part 340 having scraping edge 304A.

Leading edge 304 or replaceable wear part 340 having a leading edge 304A fits just inside barrel 23. On the upstroke, leading edge 304 or replaceable leading edge 304A collects solid particles in a circumferential groove 315 which acts as a gathering surface for the particulate matter.

Figure 4C:
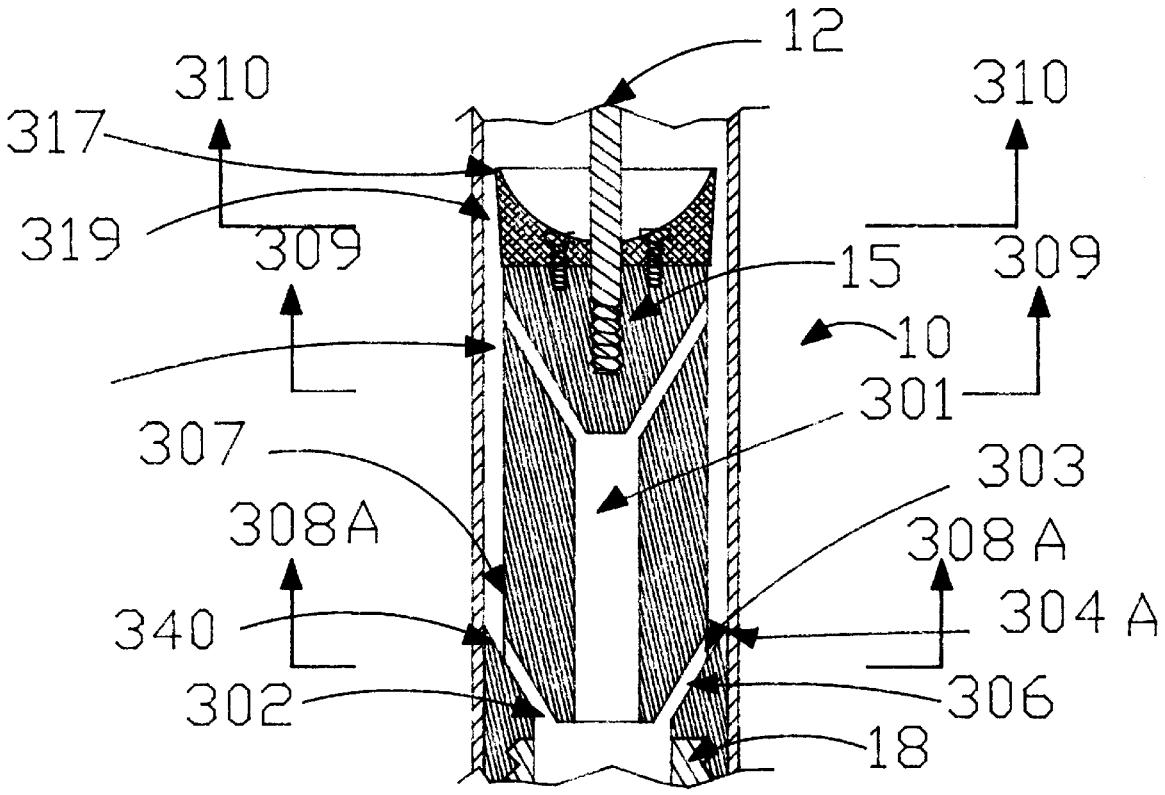
FIG. 4C is an enlarged view of a portion of FIGS. 1A and 1B showing pump pull rod 12, turbulent flow disk 317 and scrape and flush system 350, having replaceable wear part 340 incorporating scraping edge 304A, attached to plunger connector 15.

Referring now additionally to FIG. 4C there is shown an enlarged view of a portion of FIGS. 1A and 1B showing pump pull rod 12, turbulent flow disk 317 and scrape and flush system 350, having replaceable wear part 340 incorporating scraping edge 304A, attached to plunger connector 15. Replaceable wear part 340 having leading edge 304A is attached to scrape and flush system 350 by any suitable means. Replaceable wear part 340 and leading edge 304A may be made of any material suitable to provide a durable wear surface. Preferably, replaceable wear part 340 and leading edge 304A are made of a ceramic.

On the downstroke, the collected particles are put into suspension as fluid is forced upward into flush port inlet 302 through diagonal channel 306 and out flush port outlet 303 into high velocity channel 316. The fluid and suspended particles then continue above turbulent flow disk 317. Fluid is also forced through reduced flow channel 301 where it enters angle channel 355 at inlet 302A and exits from outlet from port 303A. While not being limited by theory, the inventor believes that by continuously keeping particulate matter in suspension by use of scrape and flush system 350 aided by turbulent flow disks 317 and 318 that solids such as sand and other debris will not collect around such as to cause unnecessary wear on the pump components. Specifically, the plunger is protected from sand collecting on and wearing the plunger to prolong the plungers life and to reduce the frequency of pulling and replacing various wear parts.

Scrape and flush system 350 is then connected via threaded connection to conventional plunger 18, which is in turn connected via threaded connection to conventional traveling valve cage 21 of traveling valve 70 having seat 78 and ball 75, all of which is encased in conventional barrel 23.

Threaded connection 25 joins traveling valve cage 21 with tubular housing 27, which extends downwardly to lower housing 29 by threaded connector 31. Housing 29 in turn extends downwardly and connects to housing 33 through threaded connector 35. It is to be understood that housings 27, 29 and 33 form hollow tubular housing assembly 5 which is adapted for attachment to the traveling valve 70.

At the bottom of barrel 23 is positioned conventional standing valve 58, including conventional seat 57 and ball 56.

Piston 40 is positioned within tubular assembly 5 within pump 10 as shown, and includes actuator 241 having engaging end 241A, lower sealing member 36, upper sealing member 38, piston body 42.

Figure 2:
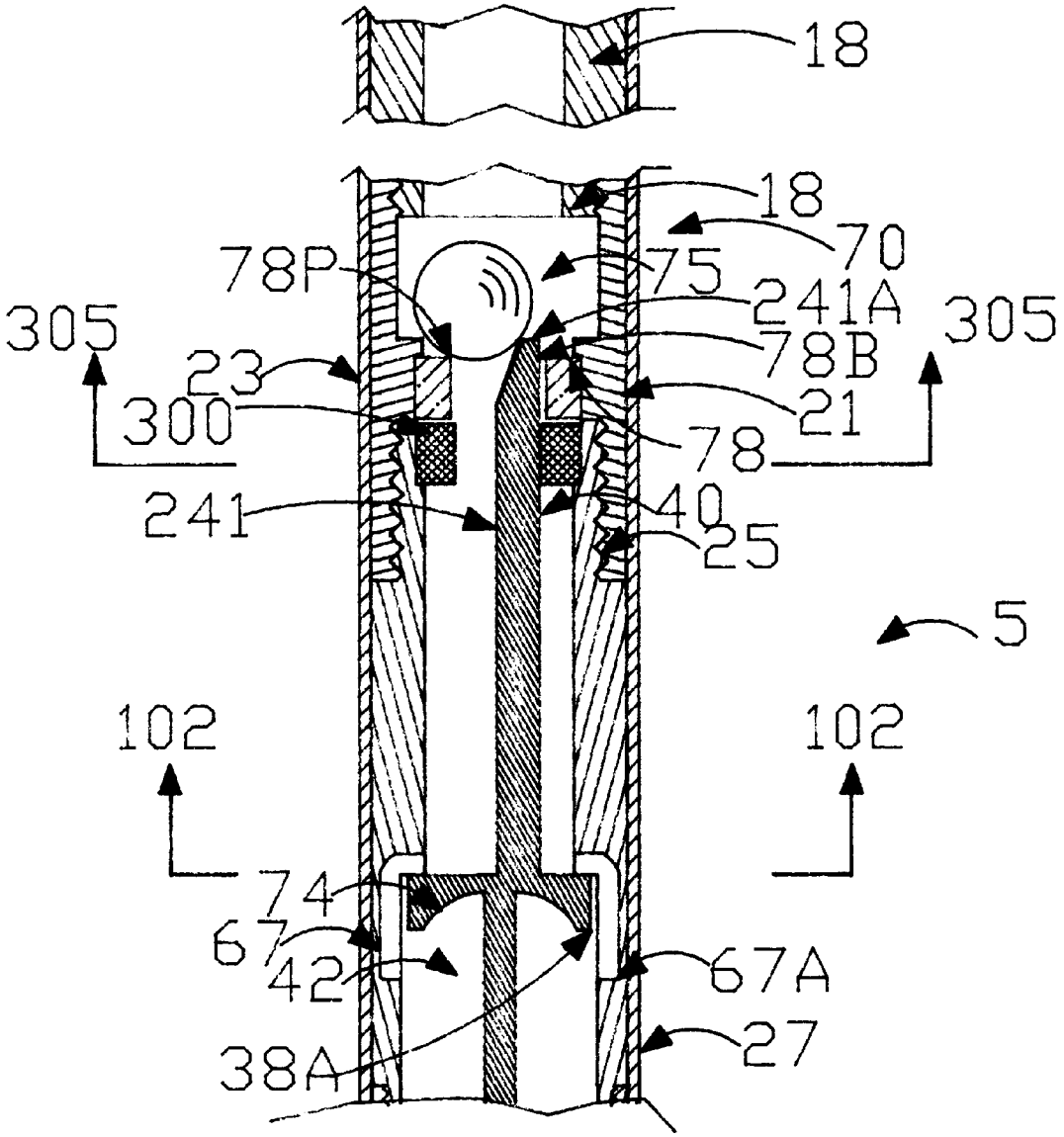
FIG. 2 is ana enlarged view of tubular assembly 5 illustrating bushing 300 actuator 241.
Figure 3:
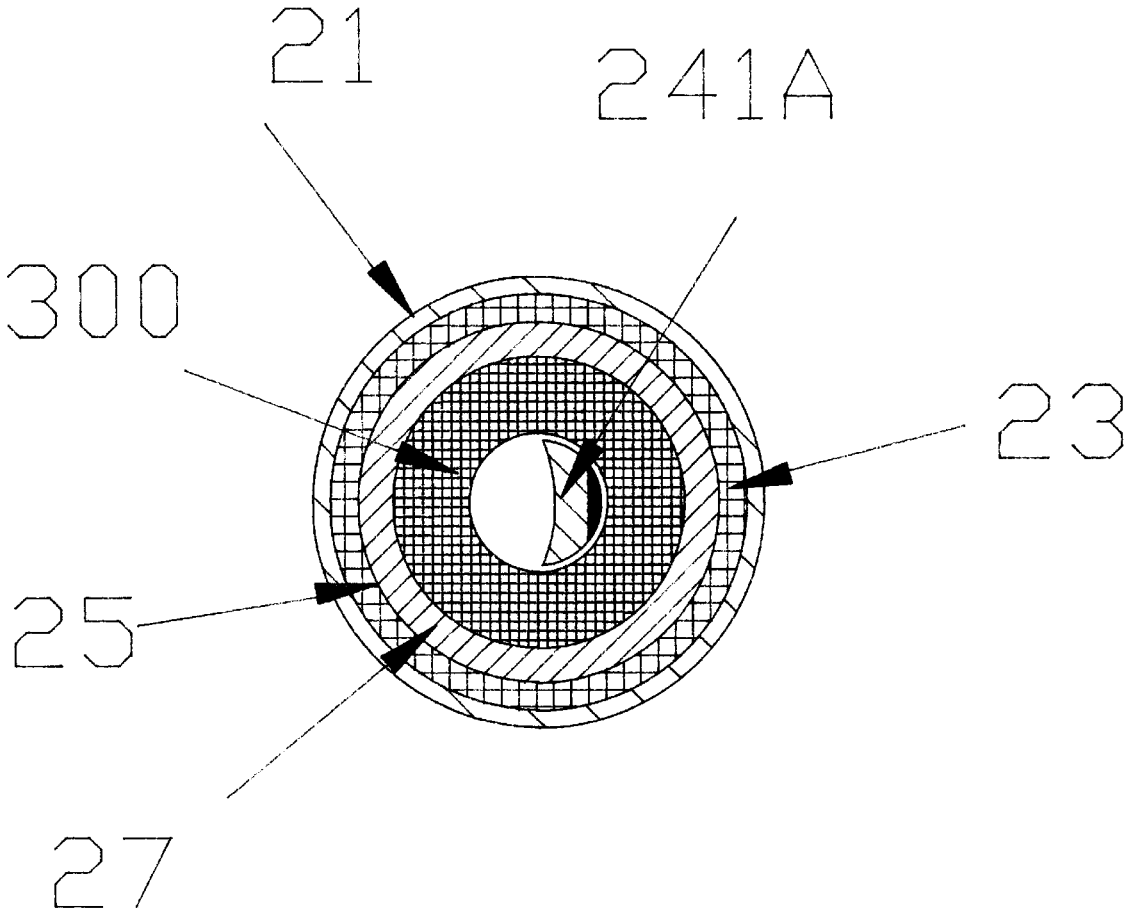
FIG. 3 is a horizontal cross-section view of bushing 300 taken along line 305—305 of FIG. 2 showing end 241A of actuator 241, tubular housing 27 barrel 23 cage 21 and threaded connection 25.

Referring now additionally to FIGS. 2 and 3 the alignment of piston 40 could be accomplished by removable alignment bushing 300. FIG. 2 is an enlarged view of tubular assembly 5 illustrating bushing 300 actuator 241 and and FIG. 3 is a horizontal cross-section view of bushing 300 taken along line 305—305 of FIG. 2 showing end 241A of actuator 241, tubular housing 27 and threaded connection 25.

Bushing or actuator guide 300 is a replaceable insert that guides the position of actuator 241 as it moves up and down. Bushing 300 provides a wear surface for actuator 241 and is positioned inside tubular housing 27. Bushing 300 controls the load and wear on actuator 241 by providing an aligning surface smaller than that of seat 78. While shown in the figures to be positioned directly below seat 78 it is understood that bushing 300 may be positioned in any location suitable to guide and align actuator 241 to protect it from wear. While not being limited by theory, the inventor believes that bushing 300 prolongs the wear life of actuator 241 by reducing the horizontal stress on actuator 241 and by absorbing some of the unseating force of ball 75.

Bushing 300 may be any suitable shape to control the alignment of actuator 241. Preferably bushing 300 encircles actuator 241. While shown in the figures to completely encircle actuator 241 it is understood that bushing 300 may encircle a smaller portion or portions of actuator 241. As a non-limiting example, actuator guide 300 may be "doughnut" shaped.

Bushing 300 may be made of any material suitable to provide a wear surface for actuator 241. Preferably, bushing 300 is made of steel or ceramic. More preferably, bushing 300 is made of steel. Optionally, bushing 300 maybe made of or coated with a friction reducing material.

The vertical motion of piston 40 in housing assembly 5 within pump 10 is restricted at its uppermost point by the engagement of upper stops 55 of housing 27 and shoulders 32 of upper sealing member 38 as shown in FIG. 1B, and at its lowermost point by engagement oflower stops 54 of housing 33 with bottom shoulder 36A oflower sealing member 36 as shown in FIG. 1A.

Liquid flow around lower sealing member 36 through channels 62 in housing 29 occurs once bottom shoulder 36A clears lower end 62A of channels 62. Generally, channels 62 are not continuously connected around the perimeter of housing 29, but rather are spaced by guides formed in the walls of housing 29. It is to be understood that any number of channels 62 may be utilize, as long as at least one channel 62 is provided. Thus, when bottom shoulder 36A is above lower channel end 62A, lower sealing member 36 is positioned in lower housing 29 by the guides formed in the walls of housing 29.

Liquid flow around sealing member 36 is prevented when bottom shoulder member 36A is positioned below lower channel member 62A. Sealing member 36 will form a seal with lower housing 29 such that pressure can be held by sealing member 36. Additional optional sealing can be provided by utilizing a sealing seat against which sealing member 36 will abut. In the embodiment shown in FIG. 1A–C, lower stop 54 is additionally a seal seat for sealing member 36. Thus, sealing is provided by sealing member 36 circumferentially abutting housing 29, and by the bottom of sealing member 36 abutting lower stop or seat 54.

Lower sealing member 36 includes sealing area 71 which may be any shape suitable to seal the internal cross-section of housing 29 below channel end 62A. In the embodiment shown, sealing area 71 is a concave shape, although any suitable shape may be utilized.

It is to be understood that in the event of fluid leakage past or failure of traveling valve 70, sealing member 36 may be designed suitable to provide backup sealing. It is also possible to eliminate traveling valve 70, and utilize sealing member 36 as the primary traveling valve.

Liquid flow around upper sealing member 38 through channels 67 in housing 27 occurs once bottom shoulder 38A clears lower end 67A of channels 67. Generally, channels 67 are not continuously connected around the perimeter of housing 27, but rather are spaced by guides formed in the walls of housing 27. It is to be understood that any number of channels 67 may be utilized, as long as at least one channel 67 is provided. Thus, when bottom shoulder 38A is above lower channel end 67A, lower sealing member 38 is positioned in housing 27 by the guides formed in the walls of housing 27.

With piston 40 at its uppermost point, with upper stops 55 of housing 27 arid shoulders 32 of upper sealing member 38 in engagement, liquid flow will still occur around sealing member 38. Flow area 79 extends downwardly along the side of sealing member 38 to form a liquid passage with channel 67. Even when shoulder 32 is abutted against stop 55 this flow area 79 is in liquid communication with channel 67, and thus allows for passage of fluid from channel 67 and past sealing member 38 through flow area 79.

Liquid flow around sealing member 38 is prevented when bottom shoulder member 38A is positioned below lower channel member 67A. Sealing member 38 will form a seal with housing 27 such that pressure can be held by sealing member 38.

Sealing member 38 includes sealing area 74 which may be any shape suitable to seal the internal cross-section of housing 27 below channel end 67A. In the embodiment shown, sealing area 74 is a concave shape, although any suitable shape may be utilized.

The embodiment of the present invention is illustrated with two sealing members 36 and 38. It is to be understood that at the very least, one sealing member must be utilized, with additional sealing members being optional. However, one problem that must be addressed is the orientation of the piston 40. While one sealing member could be modified to keep piston 40 in its proper vertical alignment, it is preferred to utilize either a second sealing member, or a rod guide to keep piston 40 aligned properly.

It is important that the sealing area of the sealing member that holds pressure against standing valve 58, which in the embodiment shown is sealing area 71 of member 36 initially, and subsequently sealing area 74 of member 38, have a sealing area that is greater than the cross-sectional area of valve seat passage 78B. Preferably, the sealing area of sealing member 36 and/or 38 will be at least 1.1 times greater than the cross-sectional area of valve seat passage 78B, more preferably at least 2 times greater, even more preferably at least 5 times greater, even still more preferably at least 6 times greater, even yet more preferably at least 9 times greater, and most preferably at least 12 times greater.

Operation of pump 10 is as follows. In the upstroke, sucker rod 322 driven by a surface pumping unit moves plunger 18, traveling cage 21 and tubular assembly 5 upward. This motion closes traveling valve 70, forces piston 40 into its downward position with shoulder 36A abutted against stop 54, and opens standing valve 58 and pulls liquid into conical area 61 of pump 10. During the upstroke, leading edge 304 or replaceable leading edge 304A collects solid particles in a circumferential groove 315. The liquid flows past flow disk 318 through flow area 320 formed between disk 318 and outer tubing 321. Flow disks 317 and 318 create turbulence above the pump to keep sand and other particles, in suspension thereby keeping the solids away from the wear parts of pump 10 such as piston 40, actuator 241, ball 75 and seat 78. The purpose of cupped edge 312 is to create turbulent flow out of pump 10 on the downstroke.

On the downstroke, plunger 18, traveling cage 21 and tubular assembly 5 are driven downward thereby closing standing valve 58 and compressing the liquid drawn into area 61 between lower sealing member 36 and the now closed standing valve 58, see FIG. 1A. With the continuing downstroke, this pressure builds and acts upon sealing surface 71 of piston 40, ultimately driving it upward. Once shoulder 36A clears channel bottom 62A liquid flow bypasses sealing member 36 by passing through channel 62. With piston 40 in this intermediate position, pressure is now being held by sealing member 38. With the continuing downstroke, this pressure builds and acts upon sealing surface 74 of piston 40, ultimately driving it upward. Once shoulder 38A clears channel bottom 67A, liquid flow goes around sealing member 38 through channels 67, and on through traveling valve 70. Piston 40 is ultimately driven to its upmost position with shoulder 32 of member 38 abutting stop 55. At this point, liquid will continue to bypass sealing members 36 and 38 through channels 62 and 67, respectively, and on through traveling valve 70.

On the downstroke, the particles collected by leading edge 304 or by replaceable leading edge 304A are put into suspension as fluid is forced upward into flush port inlet 302 through diagonal channel 306 and out flush port outlet 303 into high velocity channel 316. The fluid and suspended particles the continue above turbulent flow disk 317. Fluid is also forced through reduced flow channel 301 where it enters angle channel 355 at inlet 302A and exits from outlet from port 303A. As above, flow disks 317 and 318 create turbulent flow to keep sand and other particles in suspension which prevents collection on and wear to components of pump 10. This cycle is repeated with subsequent downstrokes and upstrokes.

Although actuator 241 is shown in the figures to strike traveling valve ball 75 asymmetrically with respect to its vertical axis, it is understood that actuator 241 may be configured to strike seated traveling valve ball 75 near its vertical center axis as it is in its seated position. Preferably, actuator 241 strikes ball 75 such as to allow it to pivot on seat 78 at pivot point 78P. More specifically, actuator 241 will strike traveling valve ball 75 asymmetrically with respect to its vertical center axis as it is in its seated position. The asymmetrical striking of traveling valve ball 75 could be achieved by angling member 241 or by offsetting member 241 from the vertical center line of pump 10.

While not wishing to be limited to theory, the inventor believes that this asymmetrical striking will create a moment that will allow the ball 75 to pivot on its seat 78 at point 78P. The inventor believes that this pivoting or prying action provides a mechanical advantage over merely forcing ball 75 in the vertical direction that will help to overcome the liquid column pressure acting downwardly on ball 75.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled the art to which this invention pertains.

I claim:

1. A ball and valve seat assembly comprising:

(a) a hollow tubular member having an interior wall defining an internal cross-sectional area;

(b) a valve seat mounted within the tubular member, having a seating passage with a seating cross-sectional area;

(c) a ball positioned within the tubular member above the valve seat;

(d) a piston moveably mounted withing the tubular member below the valve seat comprising an actuator for engaging the ball through the passage while the ball is seated on the seat and comprising a sealing member with a sealing area for sealing the tubular member below the valve seat across the entire internal cross-sectional area of the tubular member; and (e) an actuator guide defining an actuator passage for receiving the actuator positioned within the tubular member below the valve seat and positioned such that a portion of the actuator is within the actuator passage;

wherein the actuator guide has a greater cross-sectional area than the seating passage and wherein the ball and valve seat is closed by the ball being seated on the valve seat, and opened by an increase in pressure from below or a vacuum from above unseating the ball from the valve seat.

2. The valve assembly of claim 1 further comprising:

(f) at least one turbulent flow disk positioned within the tubular member above the ball and valve seat substantially spanning the cross-sectional area with the flow disk defining fluid passages providing fluid communication between the internal cross-sectional area above the flow disk and the internal cross-sect-ional area below the flow disk.

3. The valve assembly of claim 1 further comprising:

(f) at least one additional actuator guide.

4. The valve assembly of claim 1 wherein the actuator guide is made from a material selected from the group consisting of ceramic, steel or a combination thereof.

5. The valve assembly of claim 1 wherein the actuator guide is doughnut shaped.

6. The valve assembly of claim 1 wherein the actuator guide is coated with a friction reducing material.

7. A ball and seat valve assembly comprising:

(a) a hollow tubular member having an interior wall defining an internal cross-sectional area;

(b) a valve seat mounted within the tubular member, having a seating passage with a seating cross-sectional area;

(c) a ball positioned within the tubular member above the valve seat;

(d) a piston moveably mounted withing the tubular member below the valve seat comprising an actuator for engaging the ball through the passage while the ball is seated on the seat and comprising a sealing member with a sealing area for sealing the tubular member below the valve seat across the entire internal cross-sectional area of the tubular member; and (e) at least one turbulent flow disk positioned within the tubular member above the ball and valve seat substantially spanning the cross-sectional area with the flow disk defining fluid passages providing fluid communication between the internal cross-sectional area above the flow disk and the internal cross-sectional area below the flow disk;

wherein the ball and valve seat is closed by the ball being seated on the valve seat, and opened by an increase in pressure from below or a vacuum from above unseating the ball from the valve seat.

8. The valve assembly of claim 7 further comprising: (f) a system positioned within the tubular member for keeping particulate matter in suspension comprising:

i. a main body positioned within the tubular member above the ball and seat valve substantially spanning the tubular member cross-sectional area with the main body defining fluid passages providing fluid communication between the internal cross-sectional area above the main body and below the main body; and ii. a gathering surface within the fluid passage for gathering the particulate matter.

9. The valve assembly of claim 7 further comprising:

(f) an actuator guide defining an actuator passage for receiving the actuator positioned within the tubular member below the valve seat and positioned such that a portion of the actuator is within the actuator passage.

10. The valve assembly of claim 8 further comprising:

(f) an actuator guide defining an actuator passage for receiving the actuator positioned within the tubular member below the valve seat and positioned such that a portion of the actuator is within the actuator passage.

11. The valve assembly of claim 7 where the assembly includes at least two turbulent flow disks positioned within the tubular member above the ball and valve seat.

12. The valve assembly of claim 7 where the at least one turbulent flow disk is dish-shaped.

13. The valve assembly of claim 7 where the at least one turbulent flow dish further comprises at least one flow vane to aid in the production of turbulent flow.

14. A ball and seat valve assembly for use with fluids containing particulate matter comprising:

(a) a hollow tubular member having an interior wall defining an internal cross-sectional area;

(b) a valve seat mounted within the tubular member, having a seating passage with a seating cross-sectional area;

(c) a ball positioned within the tubular member above the valve seat;

(d) a piston moveably mounted withing the tubular member below the valve seat comprising an actuator for engaging the ball through the passage while the ball is seated on the seat and comprising a sealing member with a sealing area for sealing the tubular member below the valve seat across the entire internal cross-sectional area of the tubular member;

(e) at least one turbulent flow disk positioned within the tubular member above the ball and valve seat; and (f) a system positioned within the tubular member for keeping particulate matter in suspension comprising:

iii. a main body positioned within the tubular member above the ball and seat valve substantially spanning the tubular member cross-sectional area with the main boded defining fluid passages providing fluid communication between the internal cross-sectional area above the main body and below the main body; and iv. a gathering surface within the fluid passage for gathering the particulate matter;

wherein the the ball and valve seat is closed by the ball being seated on the valve seat, and opened by an increase in pressure from below or a vacuum from above unseating the ball from the valve seat.

15. The valve assembly of claim 14 further comprising:

(g) an actuator guide defining an actuator passage for receiving the actuator positioned within the tubular member below the valve seat and positioned such that a portion of the actuator is within the actuator passage.

16. The valve assembly of claim 14 where the gathering surface further comprises a replaceable leading edge.

17. The valve assembly of claim 14 where the gathering surface further includes a circumferential groove.

18. The valve assembly of claim 14 where the at least one turbulent flow disk is dish-shaped.

19. The valve assembly of claim 14 where the at least one turbulent flow disk further comprises at least one flow vane to aid in the production of turbulent flow.

* * * * *